US005461740A

United States Patent [19]

Pearson

[11] Patent Number: 5,461,740

[45] Date of Patent: Oct. 31, 1995

[54] MULTI-POSITIONAL BED

[75] Inventor: Stephen Pearson, Warminster, United Kingdom

[73] Assignee: Theraposture Limited, Warminster, United Kingdom

[21] Appl. No.: 185,789

[22] PCT Filed: Jul. 22, 1992

[86] PCT No.: PCT/GB92/01347

§ 371 Date: Jan. 21, 1994

§ 102(e) Date: Jan. 21, 1994

[87] PCT Pub. No.: WO93/01789

PCT Pub. Date: Feb. 4, 1993

[30] Foreign Application Priority Data

Jul. 23, 1991 [GB] United Kingdom ..... 9115839

[51] Int. Cl.[6] ..... A61G 7/012

[52] U.S. Cl. ..... 5/611; 5/607; 5/608

[58] Field of Search ..... 5/608, 607, 609, 5/611

[56] References Cited

U.S. PATENT DOCUMENTS

| | | | |
|---|---|---|---|
| 1,799,692 | 4/1931 | Knott | 5/611 |
| 2,870,460 | 1/1959 | Sanford | 5/611 |
| 3,584,321 | 6/1971 | Buchanan | 5/611 |
| 3,750,199 | 8/1973 | Spivey | 5/611 |
| 3,808,613 | 5/1974 | Carpentier et al. | 5/611 |
| 3,900,906 | 8/1975 | Berthelsen | 5/608 |
| 4,006,499 | 2/1977 | Young | 5/608 |
| 4,244,358 | 1/1981 | Pyers | 5/607 |
| 4,524,472 | 6/1985 | Foust | 5/611 |
| 4,847,929 | 7/1989 | Pupovic | 5/608 |
| 5,088,706 | 2/1992 | Jackson | 5/608 |

*Primary Examiner*—Michael J. Milano
*Attorney, Agent, or Firm*—Darby & Darby

[57] ABSTRACT

A multi-positional bed comprises at one end thereof a pair of pillars. One of the pillars is disposed at or near each side of the bed and at the opposite end a single pillar is disposed substantially on the longitudinal center line of the bed. The bed has a user-supporting frame, and respective mounting devices for mounting the frame to each of the pillars. Each mounting device is arranged to move lengthwise with respect to the respective pillar independently of the movement of the other mounting devices.

14 Claims, 5 Drawing Sheets

MULTI-POSITIONAL BED

BACKGROUND OF THE INVENTION

1. Field of the Invention

This invention relates to a multi-positional bed. Such beds are used in hospitals, and are also used in domestic situations and in homes for the elderly and infirm, where it is necessary to have a bed which can be adjusted to suit a particular individual or which can successively occupy a number of different positions, for example in order to reduce the risk of bed sores.

2. Description of the Related Art

In such beds the mattress rests on a supporting surface which normally consists of three or four sections pivotally connected to one another. In the case of a four-section supporting surface these are, starting from the head end of the bed, a back section, a buttocks section, a thigh section and a calf section. In the case of a three-section supporting surface the thigh and calf sections are replaced by a single section, or the buttocks section is omitted. The sections are connected to one another in such a way as to allow pivotal movement between adjacent sections about parallel axes transverse to the length of the bed. Such beds also normally have provision for the whole supporting surface to be moved vertically between high and low positions. The user normally gets into the bed with the supporting section in its low position (this is particularly convenient when the user is in a wheelchair), and the supporting surface can thereafter be raised so as to make it easier for those attending the user.

Some beds also allow the whole supporting surface to be tilted about the transverse and/or longitudinal axis of the bed. However, when these additional movements are incorporated the resultant mechanism tends to be highly complex and therefore very expensive. It is an object of the present invention to provide a bed in which all the types of adjustment referred to above are present, but which does not require a mechanism of great complexity.

SUMMARY OF THE INVENTION

According to the present invention there is provided a multi-positional bed which comprises at one end thereof a pair of pillars, one at or near each side of the bed, and at the opposite end a single pillar situated substantially on the longitudinal centre line of the bed, a user-supporting frame, and respective mounting means for mounting the frame to each of the pillars, each mounting means being arranged to move lengthwise of the respective pillar independently of the movement of the other mounting means.

Preferably, each of the mounting means comprises at least one universal joint, for example a ball joint. The end of the bed at which the pair of pillars is situated may be the head end, with the single pillar at the foot end, or the pair of pillars may be at the foot end, with the single pillar at the head end.

The mounting means are preferably moved by respective electric motors, and these motors are preferably controlled by a controller which permits pre-programmed and/or programmable control and direct operator control. The user-supporting frame preferably comprises three or four sections pivotally connected to one another as in a conventional multi-positional bed, and pivotal movement of the sections with respect to one another is preferably effected by further electric motors which are under the control of the same controller as that already mentioned.

BRIEF DESCRIPTION OF THE DRAWINGS

An embodiment of the invention will now be described with reference to the accompanying drawings, in which.

DETAILED DESCRIPTION OF THE PREFERRED EMBODIMENT

Figure 1:
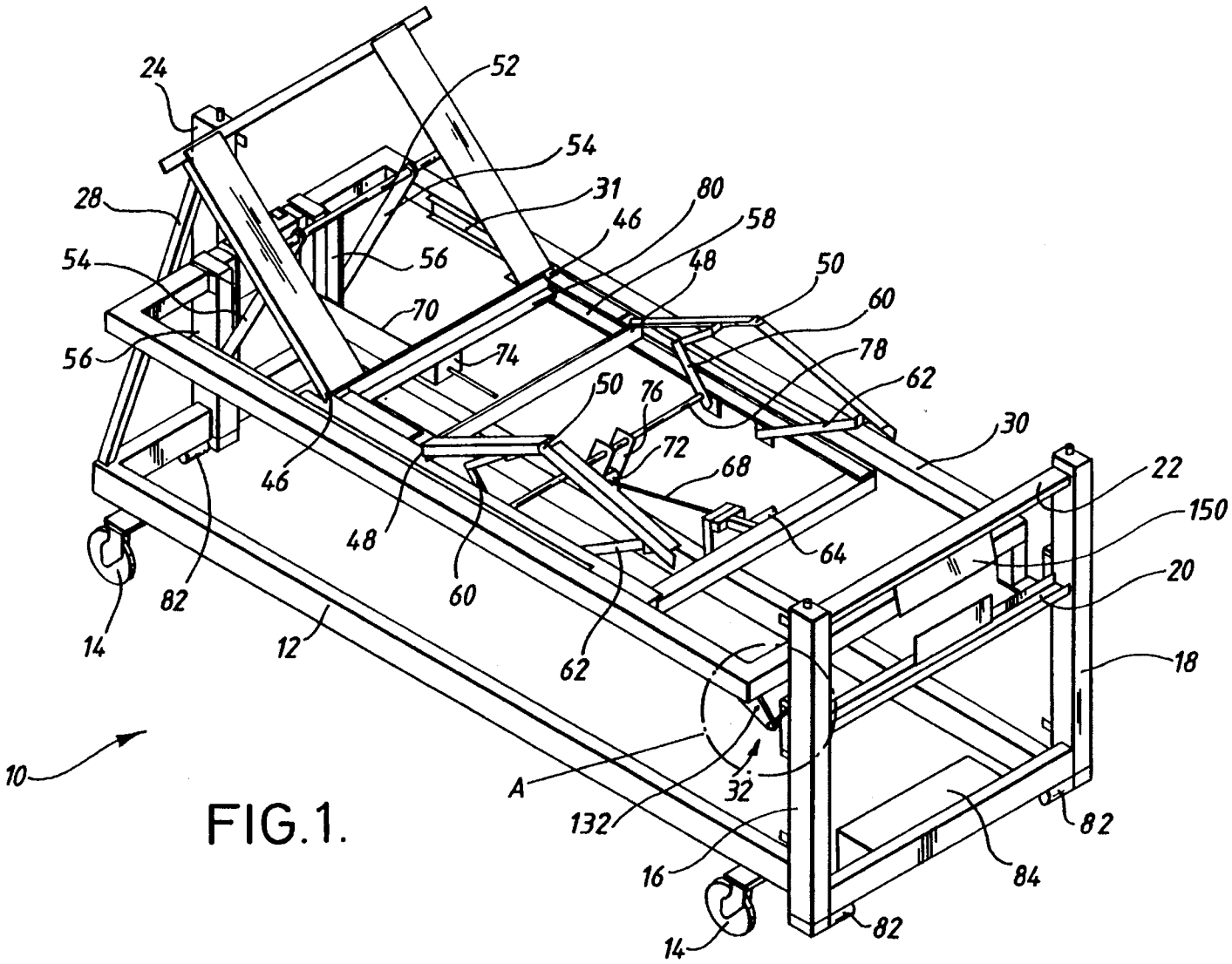
FIG. 1 is an isometric view taken from the foot end of the bed and one side.

The illustrated bed 10 comprises a lower frame 12 supported on four wheels 14. At the foot end of the bed there is a pair of upstanding pillars 16 and 18 connected intermediate their ends by a cross-brace 20 and adjacent their upper ends by a top brace 22. At the head end of the bed there is a single upstanding pillar 24 which is situated substantially on the longitudinal centre line of the bed. The pillar 24 is connected at its lower end to the lower frame 12, and is connected to the adjacent corners of the lower frame by diagonal braces 26 and 28. The pillars 16, 18 and 24 are substantially identical to one another in construction. The details of that construction will be referred to further below.

The bed further comprises an upper frame 30. At the foot end of the bed the corners of the frame 30 are connected to the pillars 16 and 18 by respective mounting means 32 and 34 and at the head of the bed the frame 30 is connected at a point midway between its corners to the pillar 24 by a mounting means 36. Each of the mounting means 32, 34 and 36 is movable longitudinally with respect to its respective pillar to enable the adjacent portion of the upper frame 30 to move vertically upwards or downwards. As will become apparent from the ensuing detailed description of these mounting means, there is also some freedom of movement in other directions. This is necessary for reasons of geometry in order to permit the desired range of movements of the upper frame 30.

The longer sides of the frame 30 each have a U-section member 31 secured thereto, with the open sides of the U's facing one another. An inner frame 58 is mounted for movement longitudinally with respect to the frame 30, by means of wheels (not visible in the drawings) which are carried by the frame 58 and which run in the U-section members 31.

Figure 3:
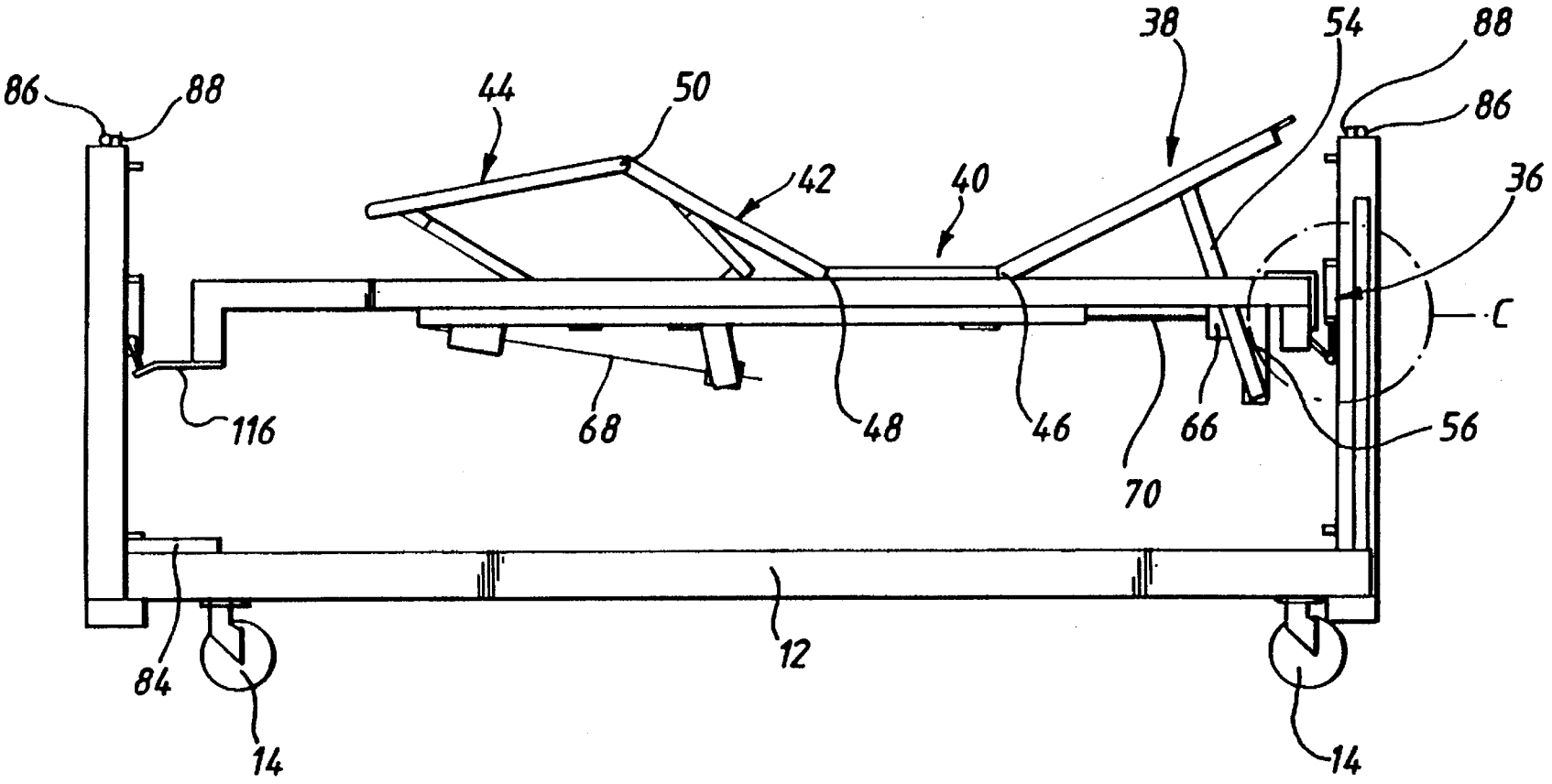
FIG. 3 is a side elevation.

The inner frame 58 has connected thereto the necessary members to define a plurality of user-supporting sections. In the illustrated embodiment there are four such sections which, as can be seen most clearly in FIG. 3, consist of a back section 38, a buttocks section 40, a thigh section 42 and a calf section 44. The buttocks section 40 is fixed with respect to the frame 58. The head section 38 is pivotally connected to the buttocks section 40 at pivot points 46, and the thigh section 42 is pivotally connected to the buttocks section 40 at pivot points 48. The calf section 44 is pivotally connected to the thigh section 42 at pivot points 50. The back section 38 has a transverse member 52 and a pair of struts 54 connect the member 52 with struts 56 which extend downwardly from the upper frame 30. The transverse member is pivotally connected at its ends to the back section 38, and the struts 54 are pivotally connected at their lower ends with the struts 56. The pivot points 46 and 48 are located in the inner frame 58. The inner frame 58 also carries pivots for the lower ends of two elbow-like linkages 60 each of which consists of two struts pivotally connected to one another, with the distal end of the upper strut being pivotally connected to the thigh section 42. The inner frame 58 further carries the pivot points for a pair of struts 62 which are each connected at their opposite ends to the calf section 44. Pivotal movement of the sections 38, 42 and 44 is effected by means of motors 64 and 66 which cause respective screw threaded shafts 68 and 70 to rotate. The shafts 68 and 70 are received in respective internally threaded blocks 72 and 74. The block 72 is mounted between a pair of arms which are fast with a cross member 78 with extends between the linkages 60. The block 74 is secured to a cross member 80, the ends of which are secured to the frame 58.

The arrangement and operation of the four user-supporting sections is basically conventional, except for the fact that the control for the motors 64 and 66 is integrated with the pre-programmed and/or programmable control of the movement of the frame 30. It is to be understood that the particular four-section arrangement within the frame 30 could be replaced by any other desired arrangement, which would not necessarily have four sections.

At the base of each of the pillars 16, 18 and 24 there is mounted a respective electric motor 82. The motors 82, and also the motors 64 and 66, are preferably low voltage DC motors, for example 12 volt motors, to which power is supplied by a 12 volt, rechargeable battery. The battery and the charger therefor are indicated diagrammatically at 84 in FIGS. 1 to 3. In use, the charger is normally kept permanently connected to a mains supply, to keep the battery fully charged. If, however, the charger has to be disconnected from the mains for any reason, or if the mains supply fails, the motors can continue to operate for some time before the battery becomes fully discharged.

Figure 5:
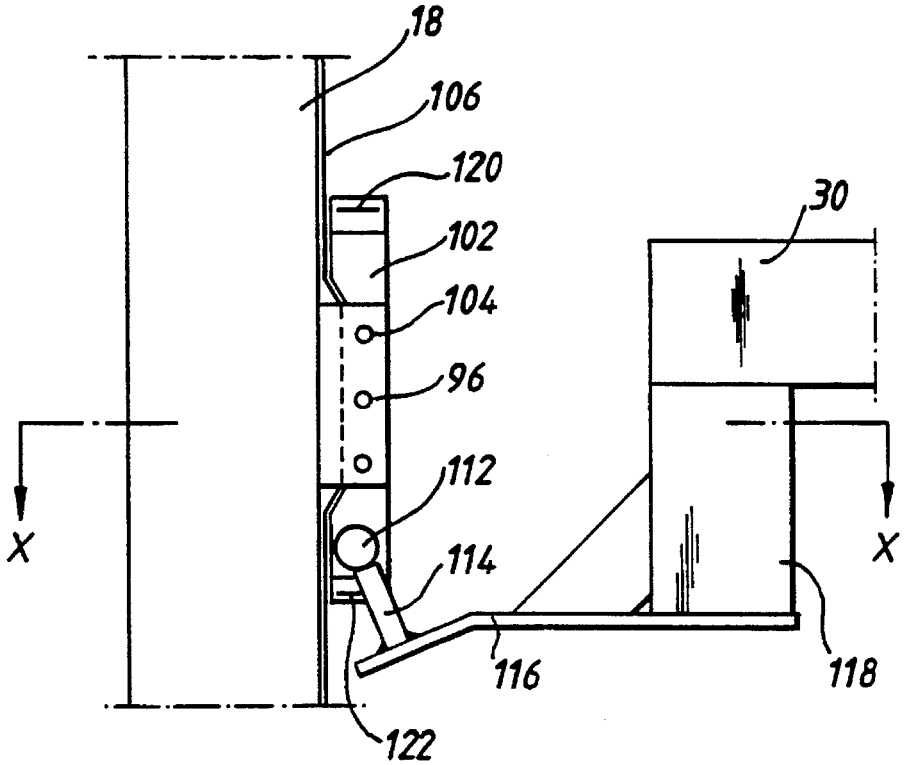
FIG. 5 shows, on a larger scale and in side elevation, the detail marked "B" in FIG. 2.
Figure 6:
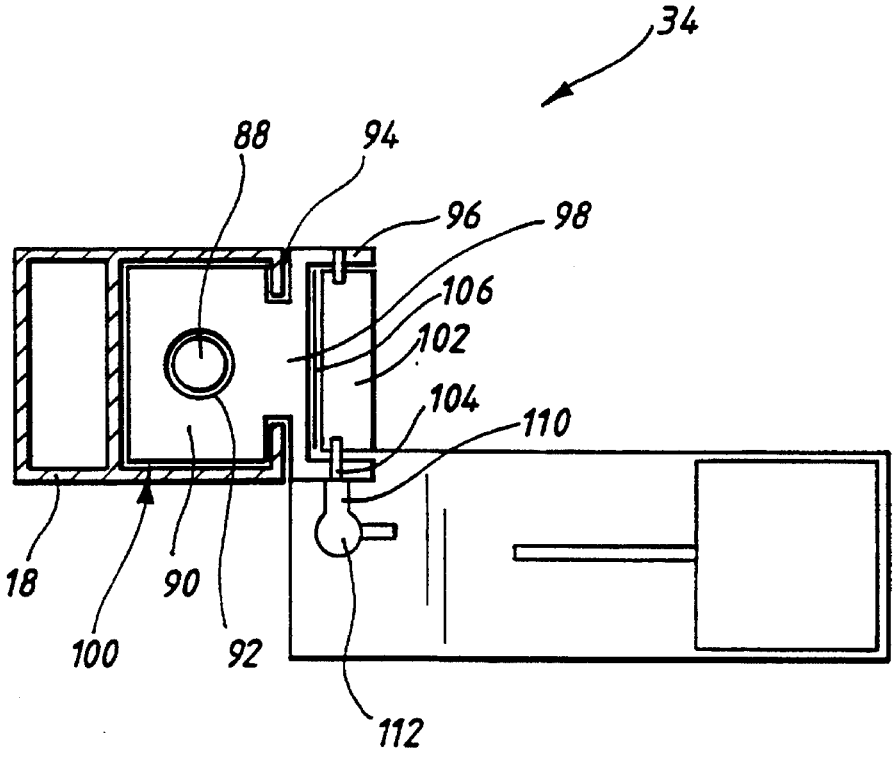
FIG. 6 is a section taken on line X—X in FIG. 5.
Figure 7:
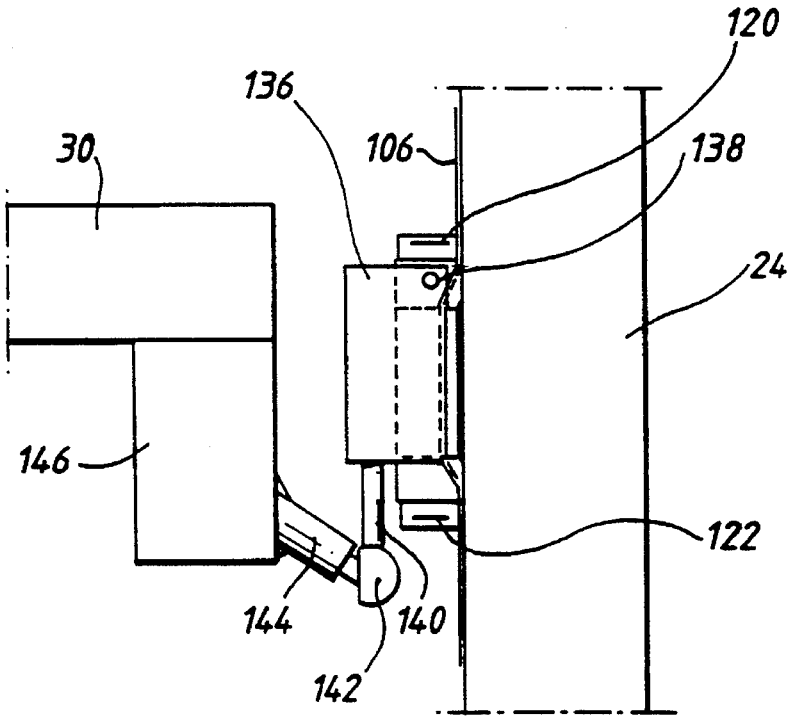
FIG. 7 shows on a larger scale, and in side elevation, the detail marked "C" in FIG. 3.

Each motor 82 is connected by appropriate gearing (not shown) to the lower end of a threaded rod which extends longitudinally within the adjacent pillar and protrudes a short distance above the top of the pillar. Each of the protruding ends meshes with a gear 86 which rotates about a horizontal axis when the respective rod rotates about its vertical axis. Rotation of the gears 86 is detected by suitable monitoring means, and signals from these monitoring means are fed to the controller to indicate the extent to which the rod has rotated in either The rods just mentioned are denoted by reference numeral 88, and FIG. 6 shows the way in which the rod 88 is disposed in the case of pillar 18. The other two rods 88 operate in a similar fashion. As seen in cross section, the pillar 18 has two hollow portions, and within the larger of them there is slidably mounted a rectangular member 90 which has an internally threaded bore 92 in which the rod 88 is threadedly received. The pillar has a longitudinal slot 94, and the rectangular member 90 is integral with a U-shaped member 96 via a bridge member 98 which extends through the slot 94. The members 90, 96 and 98 are referred to below collectively as the block 100. A further block 102 is secured within the U-shaped member 96 by fasteners 104, the block 102 extending both below and above the U-shaped member 96, as can be seen in FIG. 5.

Between the block 102 and the adjacent surface of the U-shaped member 96 there is a gap through which passes a flexible steel strip 106. This strip is secured to the pillar 18 adjacent the upper and lower ends of the pillar, and serves to cover the aperture 94 above and below where the aperture is covered by the blocks 100 and 102. The steel strip is selected to have an inherent tendency to curl away from the pillar at its upper and lower ends, so that by clamping the steel strip firmly to the pillar at those ends it is ensured that the strip remains tightly over the aperture at all points. A corresponding arrangement is provided for each of the other pillars, 16 and 24.

The block 100 has secured thereto a short shaft 110 which carries the socket 112 of a ball-and-socket joint. The ball of the joint (which is not visible in the drawings) is mounted on the end of a shaft 114 which is secured to an angled plate 116 which is fixed to the lower end of a square cross-section member 118 which extends downwardly from the adjacent corner of the frame 30. The frame 30 is therefore, in effect, hung from the ball joint and the corresponding fixings (described below) on the other two pillars, and hanging the frame in this way helps to ensure its stability.

The block 102 has a pair of electrical contacts 120 and 122 mounted on the top and bottom thereof, and these are arranged to operate microswitches 124 and 126 respectively which are provided near the top and bottom of the pillar 18. These microswitches have no function in normal operation, and are there as a safety precaution in case there should be a malfunction. Should such a malfunction cause the mounting means 34 to pass a safe upper or lower position, the microswitch 124 or 126, as the case may be, will disable the relevant motor to prevent damage occurring.

Figure 4:
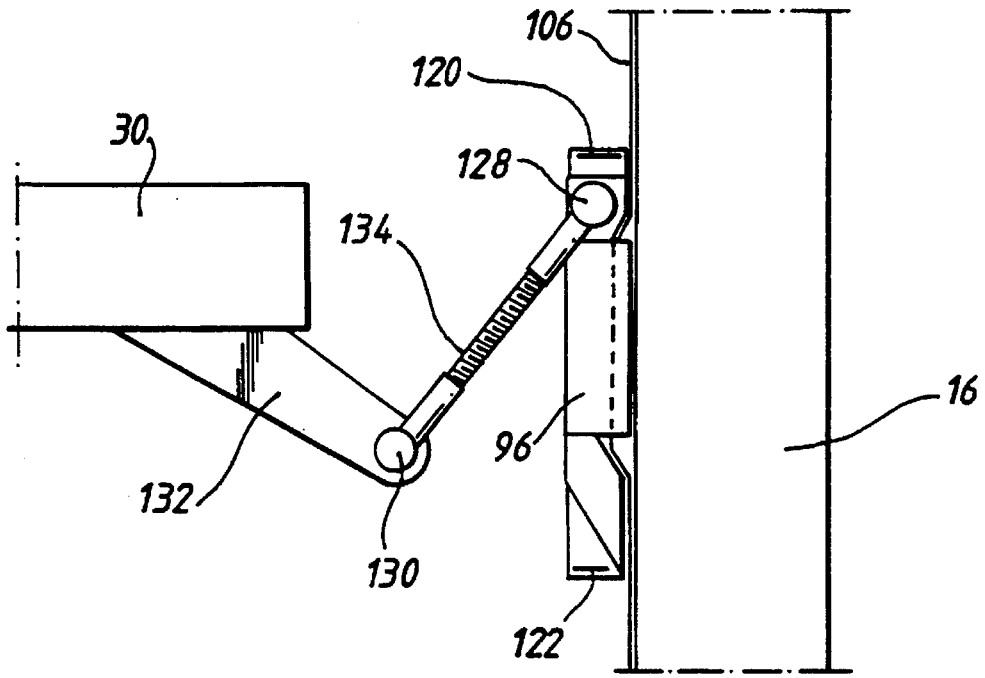
FIG. 4 shows, on a larger scale and in side elevation, the detail marked "A" in FIG. 1.

The mounting means 32 is similar in construction to the mounting means 34, but differs in the way it is connected to the adjacent corner of the frame 30. This can be seen in FIG. 4. Instead of a single ball joint, there are two ball joints 128, 130. The joint 128 is connected to the block 102 by a short shaft, and the joint 130 is connected by a short shaft to a strut 132 which extends downwardly from the adjacent corner of the frame 30. The ball joints 128 and 130 are interconnected by a connecting member 134 which is adjustable in length. The provision of two ball joints allows for additional freedom of movement of the adjacent corner of the frame 30 with respect to the pillar 16, over and above what the single ball joint allows in the case of pillar 18. This additional freedom of movement is necessary if the frame 30 is to undertake all the desired types of movement. Having only one of the pillars 16 and 18 provided with a pair of ball joints gives stability which would not be present if each of pillars 16 and 18 had a pair of ball joints. The fact that the strut 132 extends downwardly from the frame 30, and the connecting member 134 extends downwardly to the strut, means that, as in the case of pillar 18, the frame 30 is in effect hung from pillar 16.

In the case of pillar 24, a connecting member 136, which is generally U-shaped as considered in horizontal section, is connected to the block 102 by pivots 138 which permit the connector 136 to pivot about a horizontal axis to the block. A rod 140 extends downwardly from the connector 136 and terminates in the socket of a ball joint 142. The ball of the ball joint is connected by a rod 144 to a square cross-section member 146 which extends downwardly from the adjacent corner of the frame 30. It will thus be seen that, as in the case of the other two pillars, the frame 30 is in effect hung from the pillar 24.

Figure 2:
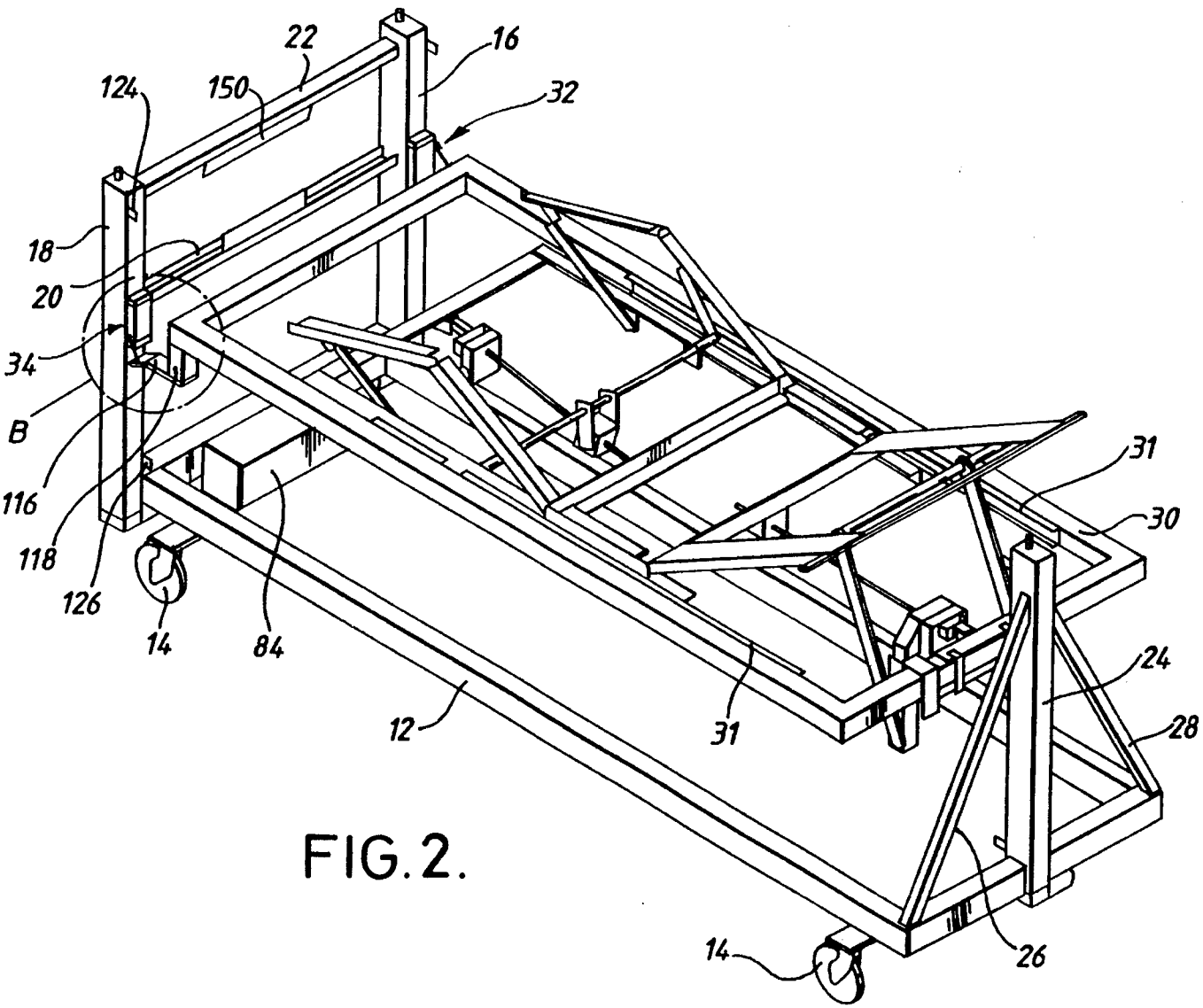
FIG. 2 is an isometric view taken from the head end of the bed and the other side.

The controller for controlling movement of the bed is mounted at the foot end and is diagrammatically indicated in FIGS. 1 and 2 by reference numeral 150. The controller preferably comprises a micro computer which can store a number of programmes, each programme containing the necessary instructions to enable the motors of the bed to execute a predetermined sequence of movements to bring the bed into a desired position, or into a series of desired positions each at a predetermined time. This facility makes it possible for those caring for the occupant of the bed, for example the staff in a hospital, to select for a particular patient a sequence of movements which will enable the patient to be brought automatically into different positions at different times and thereby relieve the staff of the need to attend so frequently to moving the patient. The programmes may be selected from a library of programmes provided with the controller and/or the controller may be provided with facilities to enable the user to construct programmes of his own to meet particular situations.

The three mounting means 32, 34 and 36 enable the frame 30 to execute a wide variety of movements. If all three mounting means move upwards or downwards to the same extent, the frame moves upwards or downwards correspondingly. If the mounting means 32 and 34 at one end of the bed move in unison, and the mounting means 36 at the other end remains stationary or moves upwards or downwards differently to the mounting means 32 and 34, the frame 30 pivots about a transverse axis. It should be noted that during such pivoting the horizontal projection of the length of the frame 30 decreases, and this is accommodated by the fact that the lower end of the connector 136 pivots away from the adjacent pillar 24. If the mounting means 32 and 34 move to the same extent as one another, but in opposite directions, while the mounting means 36 remains stationary, the frame 30 pivots about a longitudinal axis. This movement is accommodated by the ball joints with which all three mounting means are provided.

It will be appreciated that other combinations of upward and downward movement of the three mounting means will give combinations of the translational movement and two types of pivotal movement which have just been described. All these can be accommodated by the ball joints and pivotal joint which are described.

I claim:

1. A multi-positional bed which comprises at one end thereof a pair of pillars, one at or near each side of the bed, and at the opposite end a single pillar situated substantially on the longitudinal centre line of the bed, a user-supporting frame, and respective mounting means for mounting the frame to each of the pillars, each mounting means being arranged to move lengthwise of the respective pillar independently of the movement of the other mounting means.

2. A bed according to claim 1, wherein the user-supporting frame carries a plurality of user-supporting sections which are pivotally mounted with respect to one another.

3. A bed according to claim 2, wherein the user-supporting sections are mounted on an intermediate frame, which is in turn mounted on the user-supporting frame for movement with respect thereto longitudinally of the bed.

4. A bed according to claim 1, wherein each of the said mounting means comprises a universal joint.

5. A bed according to claim 4, wherein the mounting means for said pair of pillars comprises a single universal joint for one of the pillars, and, for the other of the pillars, a pair of universal joints interconnected by a connecting member.

6. A bed according to claim 1, wherein the said mounting means serve to hang the user-supporting frame from the pillars.

7. A bed according to claim 1, wherein each pillar comprises a hollow box section extending longitudinally thereof, and means for moving each mounting means are provided within the respective said box section.

8. A bed according to claim 7, wherein each said means for moving comprises a threaded rod which threadably engages a correspondingly threaded portion of the mounting means.

9. A bed according to claim 7, wherein each said box section is closed on one side by a resilient strip, the strip being secured at its ends to the box section and passing through a gap in the mounting means, whereby the mounting means is movable with respect to the strip.

10. A bed according to claim 1, comprising motor means for moving the mounting means lengthwise of the pillars, and a controller for controlling the said motor means.

11. A bed according to claim 10, wherein the controller comprises programmed or programmable means, whereby the motor means are operable in accordance with a programme stored therein.

12. A bed according to claim 11, wherein the programme is such as to cause a predetermined sequence of movements to occur, each at predetermined time.

13. A bed according to claim 10, wherein the user-supporting frame carries a plurality of user-supporting sections which are pivotally mounted with respect to one another, and wherein further motor means are provided for pivoting said user-supporting sections, said further motor means being controlled by said controller.

14. A bed according to claim 10, wherein the user-supporting frame carries a plurality of user-supporting sections which are pivotally mounted with respect to one another, the user-supporting sections being mounted on an intermediate frame, which is in turn mounted on the user-supporting frame for movement with respect thereto longitudinally of the bed, and wherein further motor means are provided for moving the intermediate frame longitudinally, said further motor means being controlled by said controller.

* * * * *